United States Patent [19]
Charamathieu et al.
[11] 4,424,769
[45] Jan. 10, 1984

[54] PROCESS AND APPARATUS FOR REMOVAL OF THE SLUDGE DEPOSITS ON THE TUBE SHEET OF A STEAM GENERATOR

[75] Inventors: André G. Charamathieu, Gif sur Yvette, France; Jean Dessales, deceased, late of Gif-sur-Yvette, France; by Blanche A. Dessales nee Vacher, administratrix, Paris; Bernard P. Lebouc, Courbevoie, both of France

[73] Assignees: Framatome, Courbevoie; Societe de Travaux en Milieu Ionisant (S.T.M.I.), Gif-sur-Yvette, both of France

[21] Appl. No.: 433,184

[22] Filed: Oct. 6, 1982

[30] Foreign Application Priority Data

Oct. 6, 1981 [FR] France ..... 81 18760

[51] Int. Cl.³ ..... F22B 37/52
[52] U.S. Cl. ..... 122/392; 15/316 A; 122/391
[58] Field of Search ..... 122/382, 390, 391, 392; 15/316 R, 316 A

[56] References Cited

U.S. PATENT DOCUMENTS 4,273,076 6/1981 Lahoda et al. ..... 122/392
4,276,856 7/1981 Dent et al. ..... 122/392 X

FOREIGN PATENT DOCUMENTS 2445487 7/1980 France .

*Primary Examiner*—Edward G. Favors
*Attorney, Agent, or Firm*—Pollock, Vande Sande & Priddy

[57] ABSTRACT

For removal of the sludge deposits on the tube sheet of a steam generator which comprises, in a vertical cylindrical enclosure closed by said sheet, a bundle of parallel heat exchange U-shaped tubes sealingly connected to said sheet at both ends and distributed to form parallel sheets of tubes, a lance is radially moved from the center of the tubular plate between two parallel sheets of tubes rather than in the tube lane. Movement occurs in a direction parallel to the tube sheet and in close proximity to the latter. Two streams at least of cleaning fluid under a high pressure are directed toward the plate from the end portion of the lance and in directions which are fixed and symmetrical with respect to the direction of the two sheets of tubes. The streams are cut off as they confront the tubes during radial movement of the lance. And the cleaning fluid is flown out of the enclosure of the steam generator from the periphery of the bundle of tubes.

10 Claims, 16 Drawing Figures

Fig.2B.
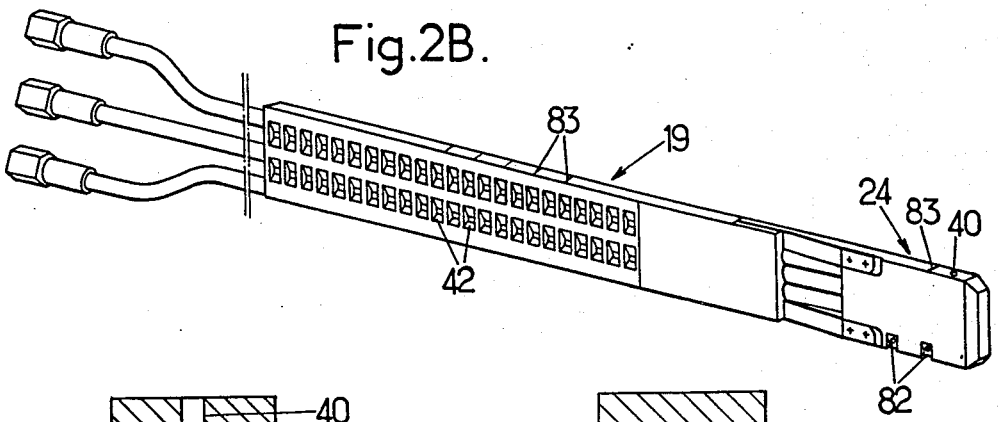
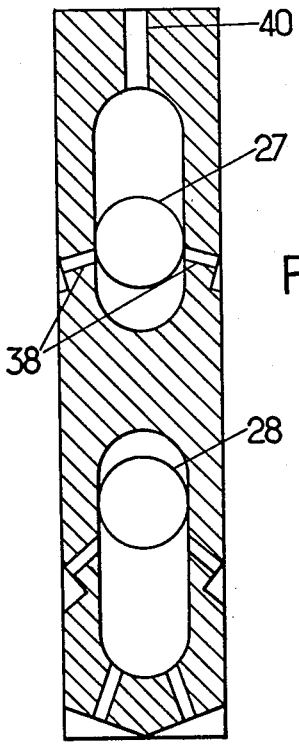
Fig.2A.
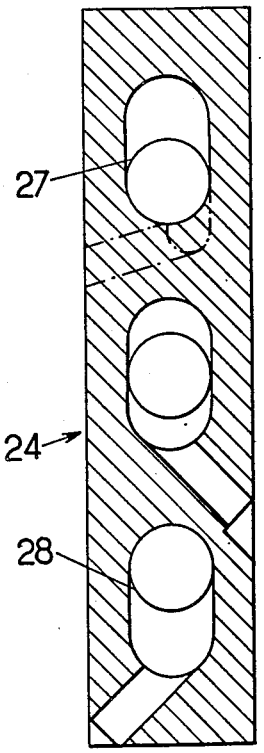
Fig.2D.
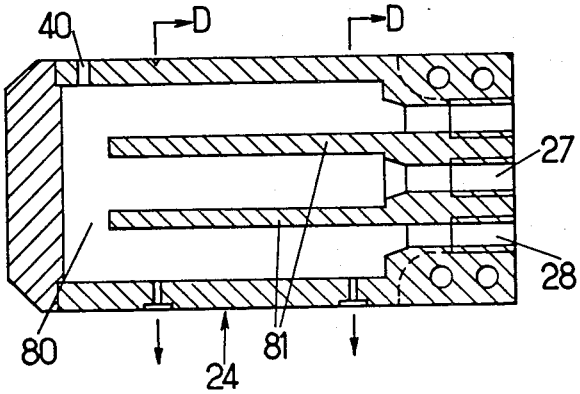
Fig.2C.

PROCESS AND APPARATUS FOR REMOVAL OF THE SLUDGE DEPOSITS ON THE TUBE SHEET OF A STEAM GENERATOR

This invention relates to a process and an apparatus for sludge lancing suitable for use in removing the sludge deposits on the tubular sheet of the steam generators of the type which comprises, in a vertical cylindrical enclosure closed by said sheet, a bundle of parallel tubes sealingly connected to said sheet, distributed to form parallel sheets of tubes. In operation, a hot primary fluid circulates in said tubes. The invention is particularly important for use in those steam generators which are currently designated as of the recirculating type, in which water separated from steam at the outlet of the secondary circuit is circulated to the inlet at the same time as feed water, whereby a layer of sludge containing magnetite deposits on the tube sheet. In the long run, there is formed an adherent and compact layer of sludge which results into corrosion of the exchange tubes in the zone close to the tubular sheet. It is consequently necessary to periodically remove the sludge for avoiding degradation of the steam generator.

It has been found that attempts to flow out the sludge before they form a compact layer, for instance using succion headers (French patent specification No. 2,285,573) are not sufficient for avoiding accumulation of sludge.

A number of processes and apparatuses have been proposed and used for removing sludge. Most of them are specifically designed for use in steam generators whose heat exchange tubes have an inverted U shape with the two end portions secured to the tubular sheet. The surface of the sheet opposed to the tubes defines a chamber with a lower half spherical cover and is separated by a dividing plate into two compartments. One of the compartments is in communication with the "hot" leg of each tube while the other compartment is in communication with the "cold" leg of each tube. In the steam generators of that type which are used in the PWR power plants, water under pressure from the reactor flows into the "hot" compartment, along the hot and cold legs, then into the second compartment before it returns to the reactor. In such steam generators, an interval higher than that which separates adjacent sheets of tubes exists, since there is a limit as to the curvature to be given to the U tubes.

The existing processes make use of that greater interval, frequently called the "tube lane". A lance is introduced above the tube sheet and into the tube lane through a hole in the enclosure of the steam generator. That lance is used for throwing streams of water under a high pressure tangentially to the tube sheet. Then, the lance is removed radially with respect to the vertical axis of the steam generator for sweeping the tubular plate. As a general rule, a lance is used which delivers two streams in opposite directions, perpendicularly to the direction along which the lance is introduced. That lance is simultaneously moved toward the axis and oscillated (French patent specification No. 2,352,269). Typically, the lance is introduced in one direction for cleaning a first half of the tube sheet, then in the opposite direction from a hole which is opposed to the first, for cleaning the second half. For drawing the sludge removed by the streams, a circulation of water is organized at the periphery of the plate between two holes formed in the enclosure in opposite relation. The rate of flow which is introduced by one hole is split into two fractions which circulate in a peripheral lane on both sides of the tube lane and are both collected by the same header for flow out of the enclosure.

Another approach consists of drawing water and sludge into a flexible annular header provided with distributed holes, introduced into the peripheral lane.

That approach, which appeared quite natural and most satisfactory to those skilled in the art, since it makes use of the relatively large tube lane, is not without drawbacks: when the lance is oscillated, that stream which is directed upwardly is not effective to remove sludge; much to the contrary, it results in running of water which may transport back the sludge which have not been immediately drawn out at the periphery toward the center portion of the tube sheet. In particular zones, the water streams delivered by the nozzle jets of the lance and those for sweeping may have opposite effects and tend to result in a local deposit of the removed sludge. Due to their composition, the sludges become solid as soon as they are deposited and it is almost impossible to draw them by succion without first directing a stream of water for them to be diluted and suspended in water. Last, the water pressure which may be used should remain moderate (about 150 bars) for avoiding damages to the tubes under the action of high speed streams. That pressure may be not sufficient for destroying a layer of sludge which has become solid and quite adherent.

It is a first object of the invention to provide an improved process for removing sludge; it is a more specific object to achieve a more efficient cleaning by improving the destruction of the layer and orginizing the flow lines for avoiding return of sludge portions toward already processed zones. It is still another object to provide a process which requires relatively conventional hardware and may easily be carried out when the enclosure of the nuclear reactor is within a shield, as is usual in PWR plants for retaining missiles in case of incident.

For that purpose, a process according to the invention comprises the steps of: radially moving at least one lance (and typically symetrically moving two lances radially) from the center of the tubular plate between two parallel sheets of tubes, in a direction parallel to the tube sheet and in close proximity to the latter, i.e. in a tube row lane; two streams of cleaning fluid under a high pressure are directed toward the plate, from the end portion of the lance and in directions which are fixed and symmetrical with respect to the direction of the sheets of tubes; the streams are cut off as they confront the tubes during radial movement of the lances; and the cleaning liquid (which is typically water) is flowed out of the enclosure of the steam generator from the periphery of the bundle.

Since the streams are cut off when in front of the tubes, very high pressures may be used without risk of damage to the tubes and consequently the layer of sludge may be rapidly destroyed. The tubes may be quite close to the lance, since there is no requirement to oscillate the latter and the tubes are not subjected to the streams. The heat exchange tubes may even constitute guides maintaining the lance into position. In a U tube-steam generator, the current spacing between adjacent sheets of tubes is sufficient for circulating the lance and it is consequently not necessary to introduce the lance through the tube lane.

Such freedom in selecting the place where the lance is inserted is of particular interest in the existing steam generators which have a distribution plate parallel to the tube sheet, located above and close to the latter, formed with a central opening for guiding water and for avoiding zones of dead flow favorable to sludge deposit. That plate confronts large diameter holes, frequently called "hand hole" formed in the enclosure in front of the tube lane. In such steam generators, oscillating lances can be introduced through the hand hole only above the distribution plate, whereby the field of action of the streams is severely limited.

On the other hand, the lances delivering streams having a fixed angular position which are used in the process of the invention (which lances have a small transverse size for being introduced between adjacent sheets of tubes) can be inserted into the enclosure through low diameter holes called "eye-holes" which are frequently formed in the enclosure in a direction perpendicular to the hand holes, between the distribution plate and the tube sheet.

Cleaning will typically be carried out in successive sequences, with different lances which direct streams striking the tube plate in zones which are more and more remote from the lance (or lances) as the cleaning process proceeds. Consequently, sludge is progressively thrown toward the periphery of the bundle where it is collected and drawn out by a suction device.

Deposit of loose sludge torn out by the water streams should be avoided. For that purpose, a first approach consists of using four sections of tube distributed into two pairs. Each pair is introduced through a hole located 90° apart from the direction of movement of the lance (or lances) and each section is located in the peripheral lane on an angular extent of 90°. The four sections consequently occupy the whole of the peripheral lane. They are connected to a suction apparatus, which may be a water ejector.

In a second approach, a circulation of water in a single direction is formed along the peripheral lane, by injecting and drawing water through and to headers which project through the enclosure at diametrically opposed points. Still another approach, which may be used in combination with the first one, consists of collecting sludge with an aspirating apparatus laid on the tube sheet at the peripheral of the latter.

It is still an other object of the invention to provide an apparatus for sludge removal which is simple in construction and efficient in operation, suitable for carrying out the above-defined process.

An apparatus according to the invention comprises at least a lance having a transversal size low enough for being insertable between two adjacent sheets of tubes, having an end portion with nozzle jets angularly located for directing sloped streams in substantially symmetrical directions with respect to the sheets towards the tube sheet or plate in service. Means are provided for feeding high pressure water to the lance and for cutting off water feed when the nozzle jets are in front of tubes; a mechanism radially moves the lance from the center portion of the enclosure toward the outer portion while retaining it in a fixed angular position. Means are provided at the periphery of the bundle of tubes for collecting and evacuating sludge loaded liquid.

The end portion of the lance will typically have a head of flat cross-section with two nozzle jets, having a thickness small enough to be insertable between two adjacent sheets of tubes and a height selected for sufficient rigidity of the lance. The lance should be stiff enough for avoiding substantial flexure in the vertical direction while the height should be low enough for authorizing introduction of the lance through a hole formed in the enclosure. The head may be provided with a jet in an upper part, directing a balancing stream upwardly.

The steam generators of the nuclear plants are frequently located inside a missile protection shield. The free space available between the enclosure of the steam generator and the shield is frequently lower than the overall length of the lance to be introduced into the steam generator radially. For overcoming that difficulty, the lance may preferably be designed for being horizontally flexible while it is stiff in the vertical direction for accepting the required amount of cantilever. The lance may be formed with evenly distributed openings for cooperation with the teeth of a driving mechanism located out of the enclosure and possibly associated with means for measuring the extent of movement of the lance and with a tube proximity sensor. That sensor carried by the head makes it possible to locate the head accurately before the streams are turned on.

The invention will be better understood from a consideration of the following description of particular embodiments, given as examples only. The examples relate to removal of the sludge deposits on the tube sheet or tube plate of a steam generator having U tubes, of the type which is currently used in PWR nuclear plants.

SHORT DESCRIPTION OF PREFERRED EMBODIMENTS

FIG. 2A is a cross-section of a modification of the lance of FIG. 2;

Figure 2:
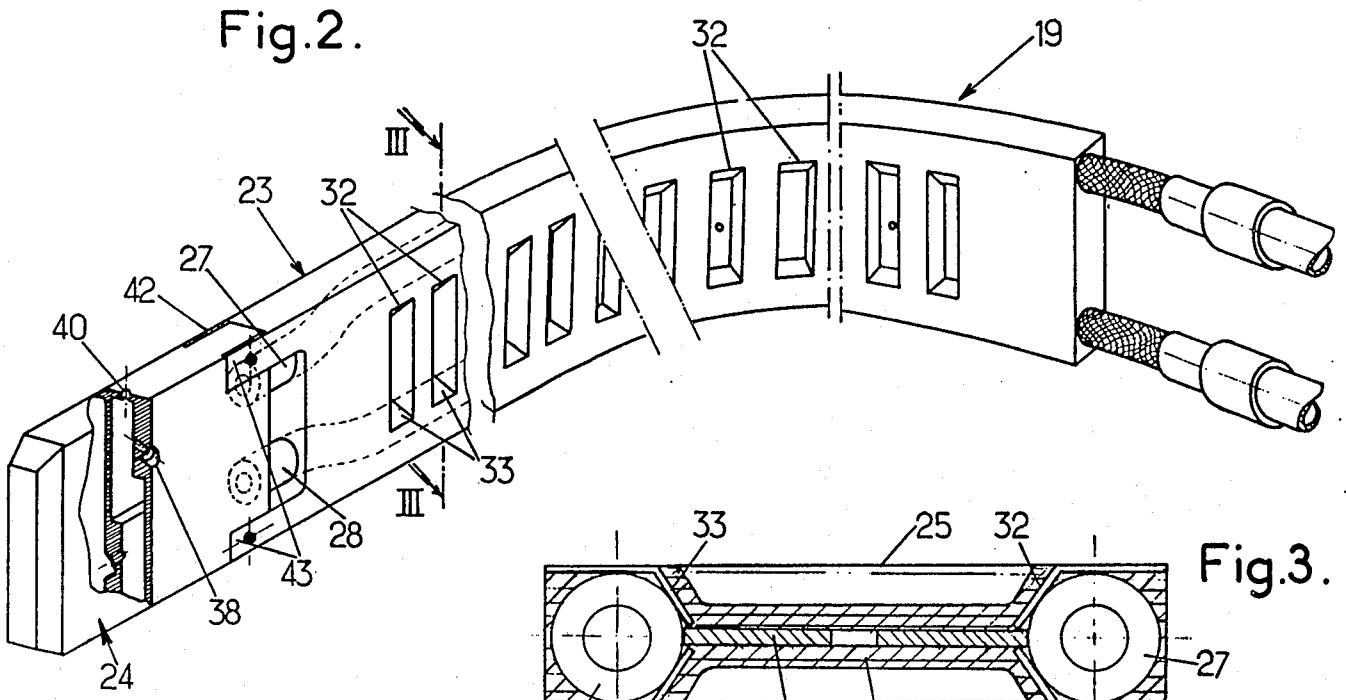
FIG. 2 is an isometric view on an enlarged scale illustrating part of a lance of the apparatus of FIG. 1.
Figure 3:
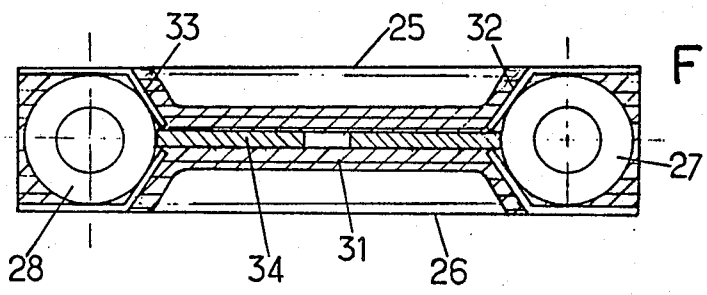
Figure 4:
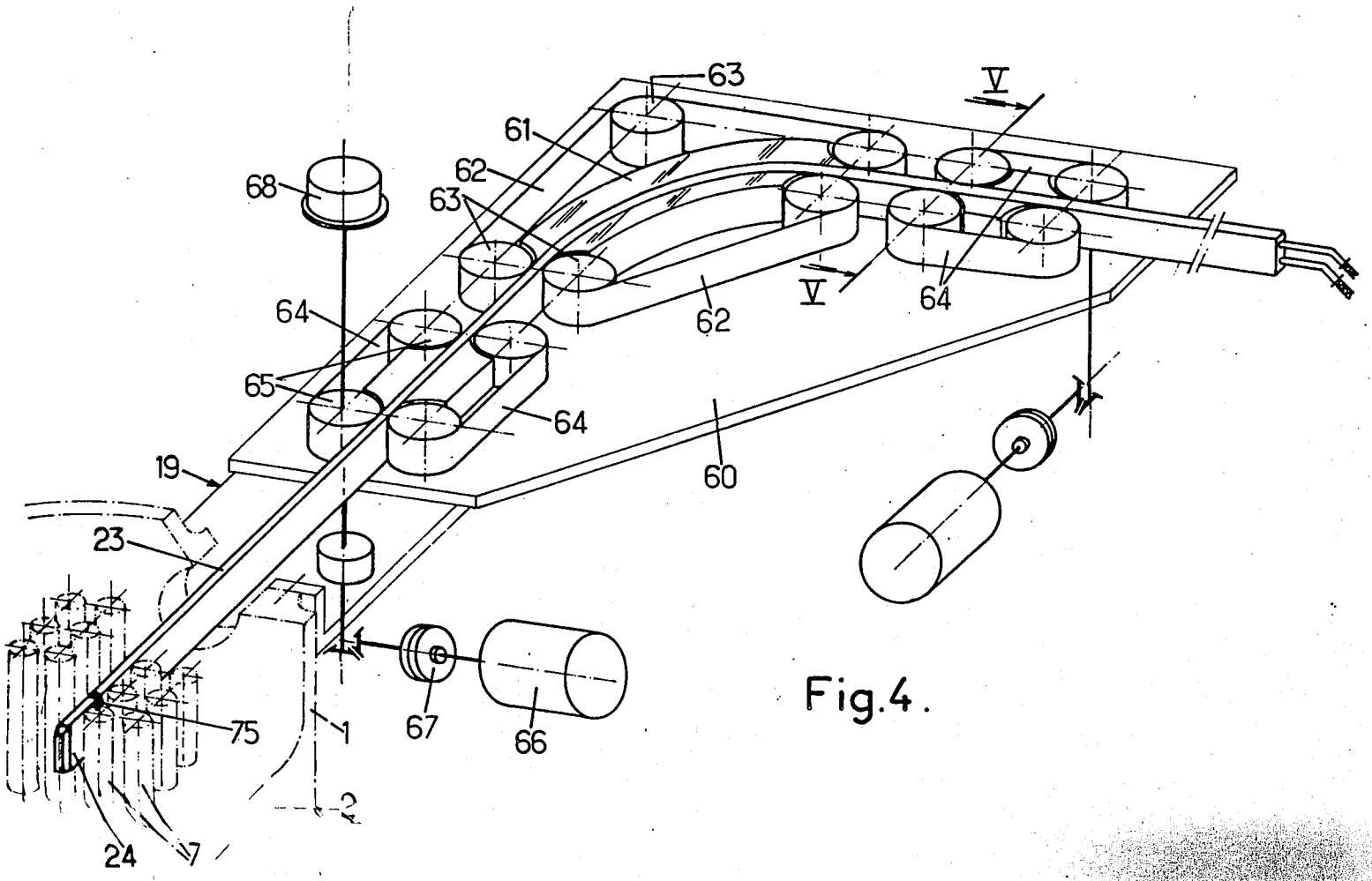
Figure 6:
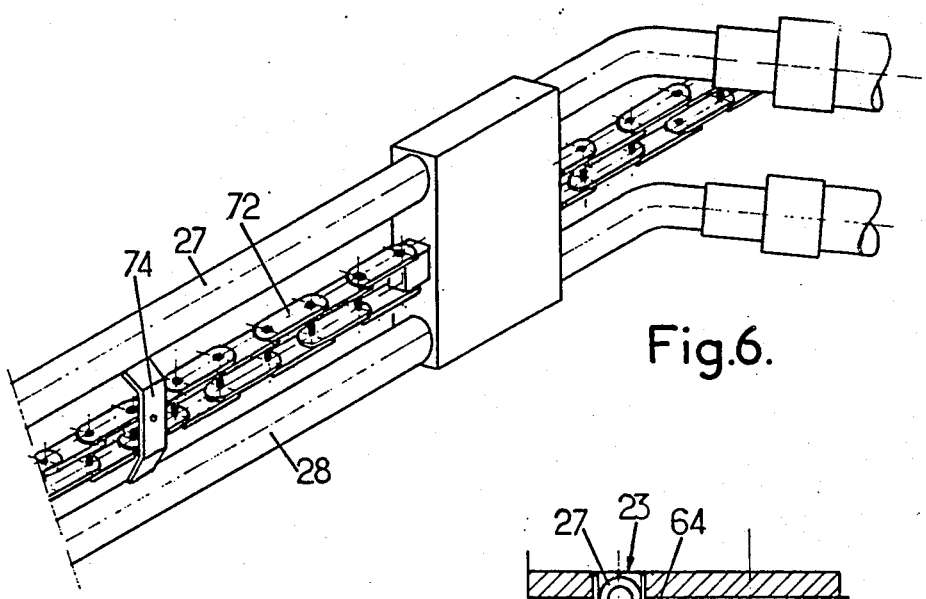
Figure 5:
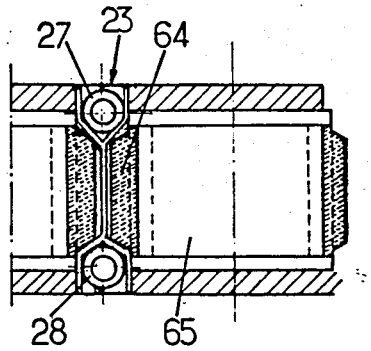
Figure 8:
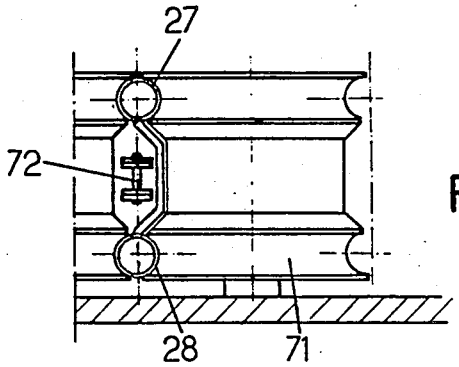
Figure 7:
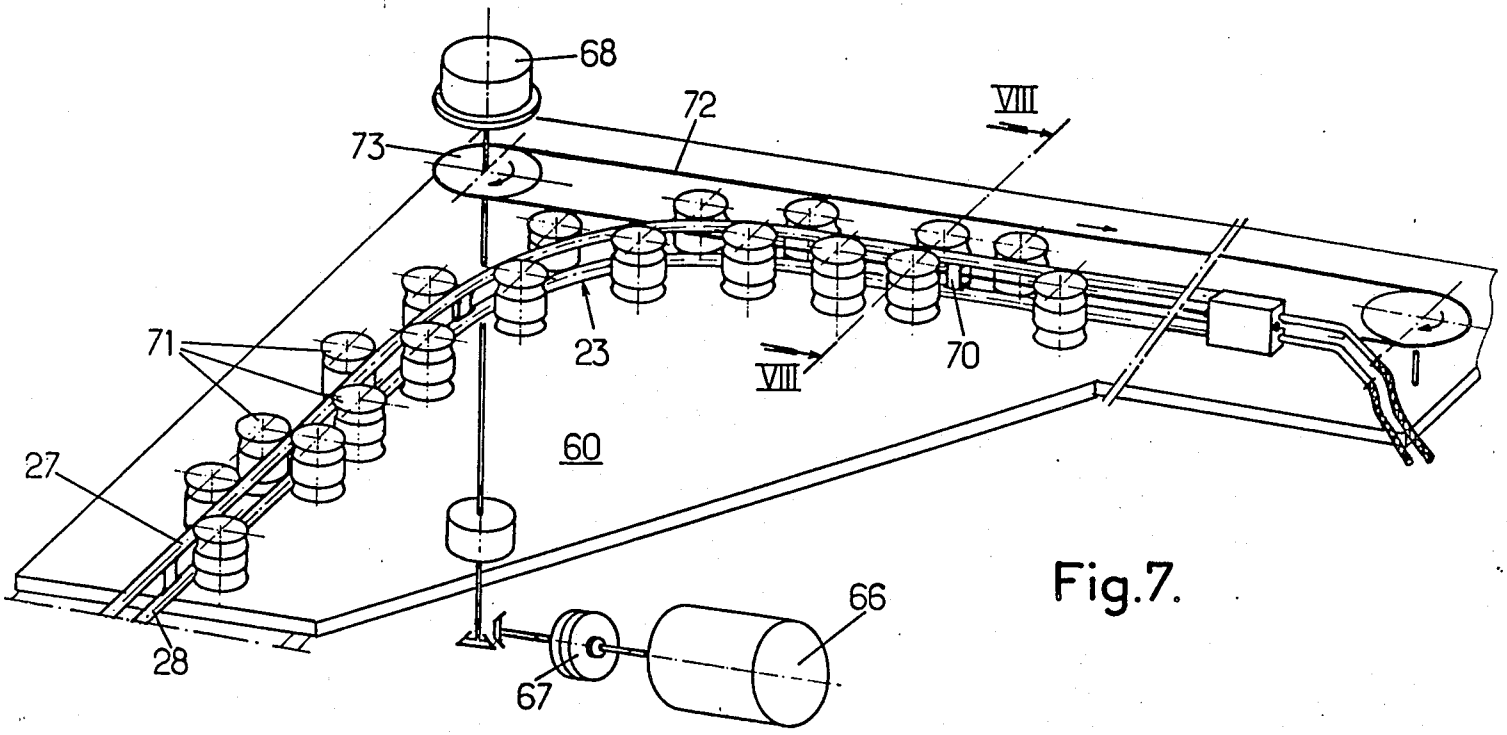
Figure 9:
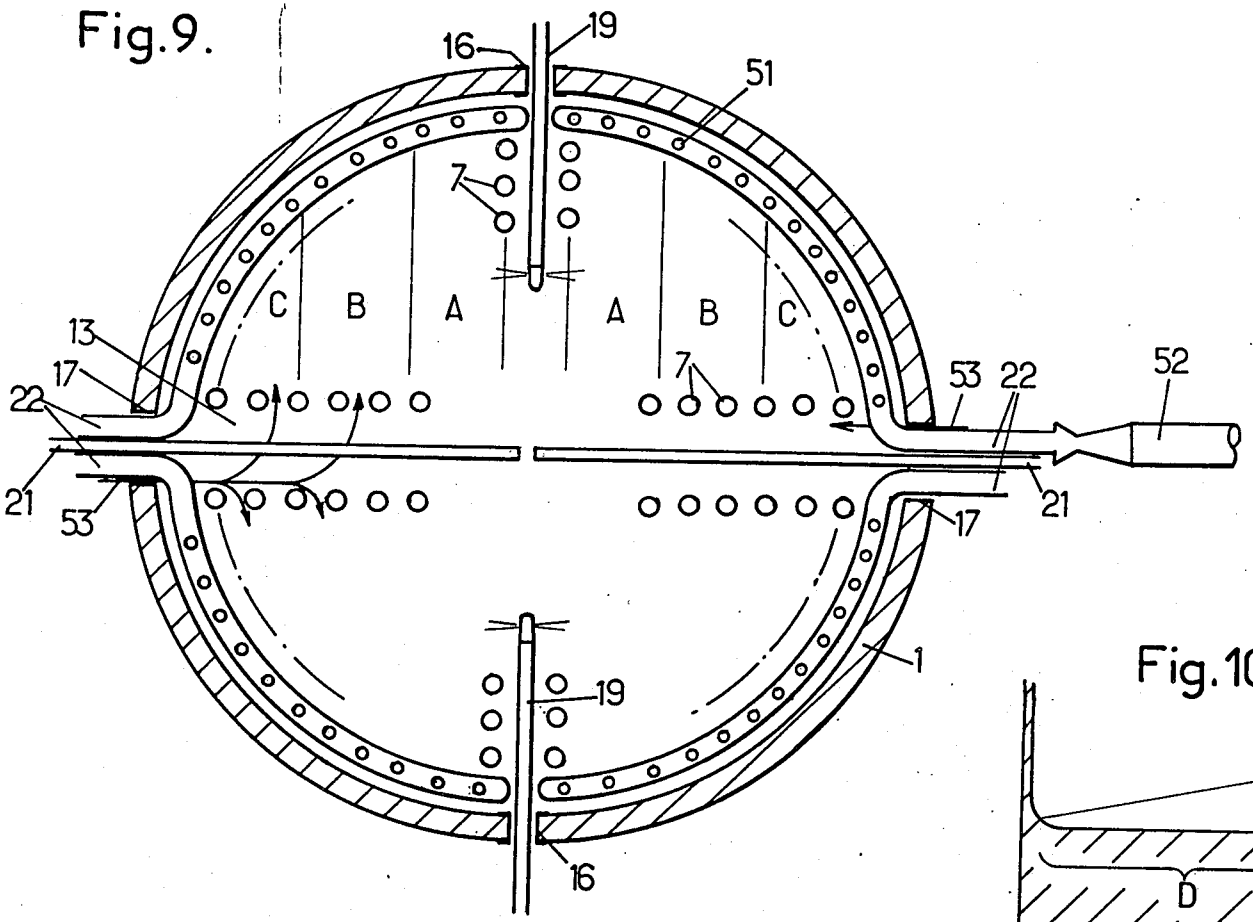
Figure 10:
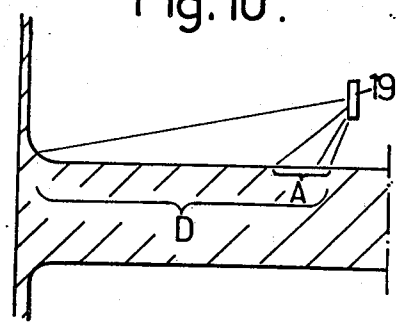
Figure 11:
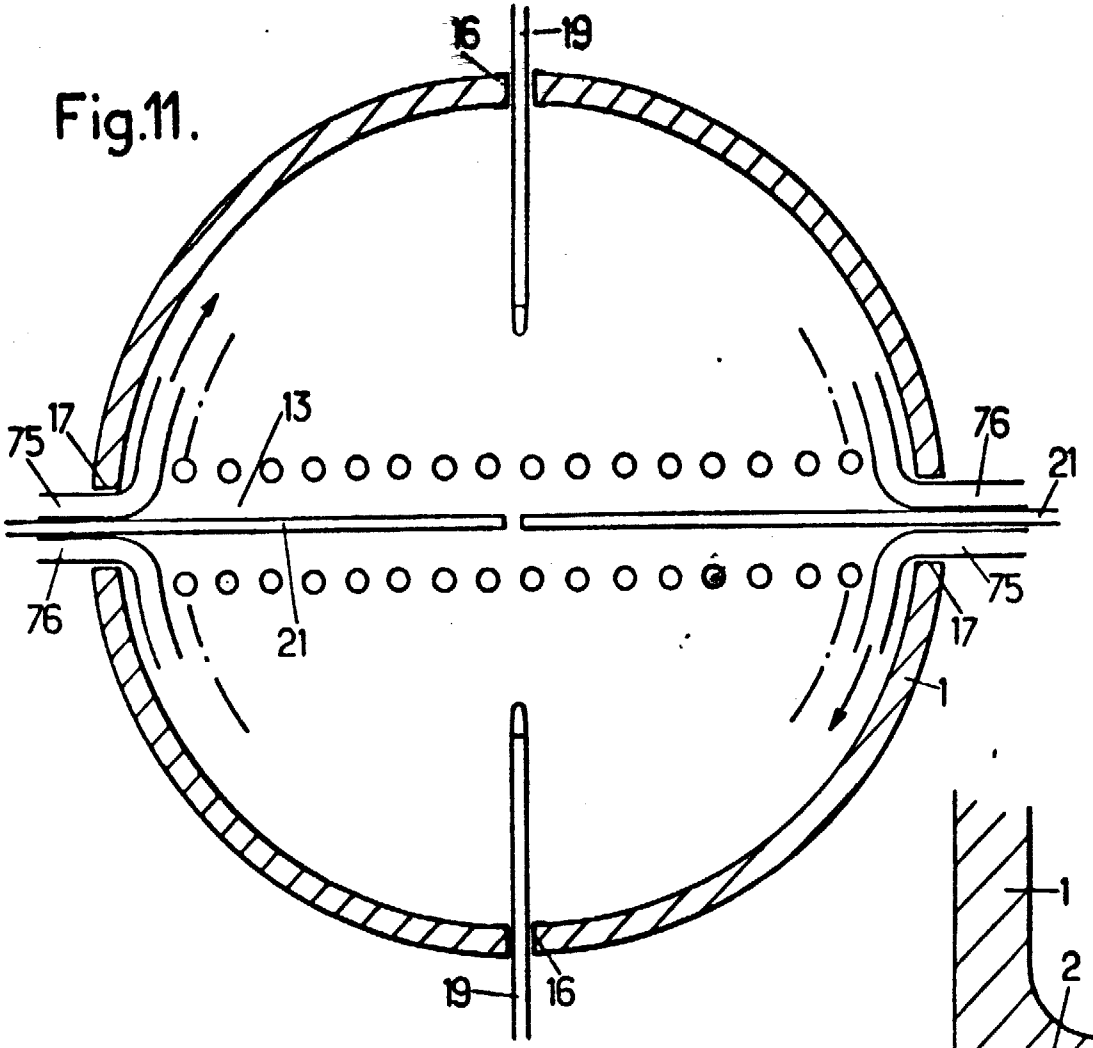
Figure 12:
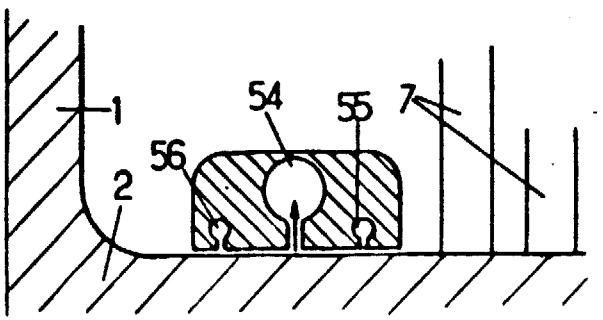

FIG. 2B, similar to FIG. 2, illustrates another modification with three feed tubes;

FIG. 2C is a longitudinal cross-section of the head of FIG. 2B;

FIG. 2D, similar to FIG. 2A, illustrates a possible modification of the nozzles constituting a modification of those of FIG. 2;

FIG. 3 is a cross-section along line III—III of FIG. 2;

FIG. 4 is an isometric view on an enlarged scale illustrating the driving mechanism associated with the lance of FIG. 2;

FIG. 5 is a cross-section along line V—V in FIG. 4;

FIG. 6 is a view on an enlarged scale illustrating a chain associated with a driving unit according to a modification of FIG. 4;

FIG. 7, similar to FIG. 4, illustrates a modified embodiment;

FIG. 8 is a cross-section along line VIII—VIII in FIG. 7;

FIG. 9 is a schematic view from above indicating the relative arrangement of the various components of the apparatus, including those for sweeping and removing sludge;

FIG. 10 is a vertical cross-section illustrating the zones which are cleaned in succession;

FIG. 11, similar to FIG. 9, illustrates a modified embodiment;

FIG. 12 is a schematic sectional view indicating a modification of the sludge removal means.

DETAILED DESCRIPTION OF PREFERRED EMBODIMENTS

First of all, a short description of the parts of the steam generator concerned with the invention will be given. A more complete description may be found in a number of documents, for instance in the aforementioned French Patent Specifications Nos. 2,285,573 and 2,352,269.

The steam generator has a pressurized enclosure or shell 1 whose lower portion is closed by a tube plate or tube sheet 2. The end portions of heat exchange U-tubes 7 are sealingly connected to the plate sheet. The enclosure 1 is extended under the tube plate by a half-spherical cover defining a water chamber 3 divided by a partition plate 4 into a compartment receiving hot primary water from the reactor and an outlet compartment. Primary water flows out of the outlet compartment through an outlet nozzle 6. Primary water circulates in the hot leg, then the cold leg of the U tubes 7 from one compartment to the other.

A wrapper is located between the bundle of tubes 7 and the enclosure 1. The wrapper terminates short of the tube sheet 2, whereby a gap is left free for the secondary feed water and recirculated water to flow down along the annular space between enclosure 1 and wrapper 8. It is seen that secondary water flows radially through the gap immediately above the tube sheet 2. Strengthening plates (not shown) through which the tubes project and which are formed with openings for water-stream circulation are distributed along the bundle for maintaining the tubes. A distribution plate 11 having a central opening 12 is located above the tubes sheet 2. The hot and cold legs of the tubes are separated by a free zone which is generally referred to as the "tube lane", whose width is determined by the smaller possible radius of curvature which may be imposed to tubes 7. Strengthening members 14 and a header for permanently drawing water 15 are located in the tube lane.

The cleaning apparatus makes use of access holes formed in the enclosure. In the illustrated nuclear stream generator, the accesses include two greater diameter holes 17 or "hand holes" which are diammetrically opposed, are located in front of the tube lane and approximately at the same level as the distributing plate 11. Two smaller holes 16 or eye-holes, whose diameter is typically about 50 mm, are aligned along a direction transverse to that of the hand holes, at a low distance from the tube sheet 2 (typically about 250 mm). During operation of the nuclear steam generator, holes 16 and 17 are closed by plugs also corresponding to openings formed in the wrapper 8. As a rule, enclosure 1 is within a shield (not shown) whose function is to block missiles and flying scrap which may be projected as a result of accidents.

Figure 1:
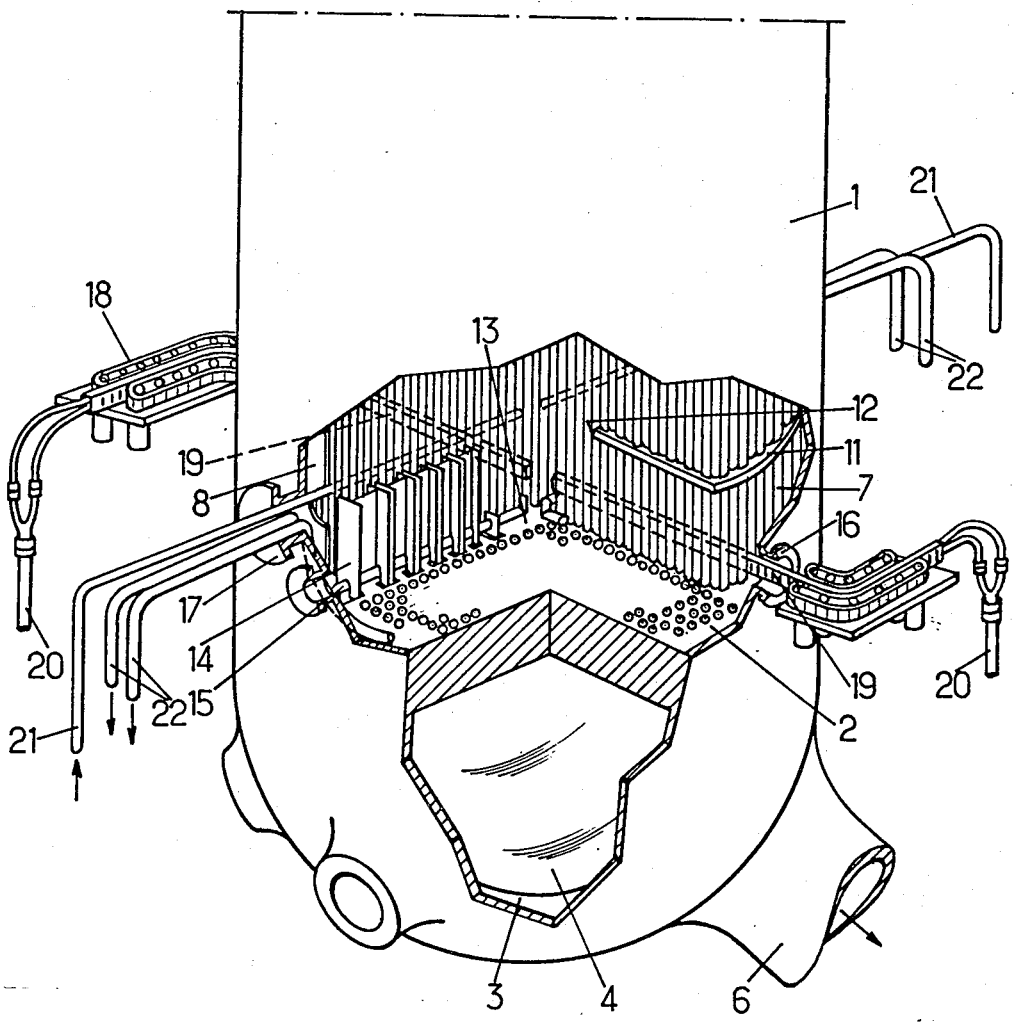
FIG. 1 is a simplified isometric view of the lower portion of a steam generator with an apparatus according to the invention inserted therein.

The embodiment of the sludge removal apparatus illustrated in FIG. 1 may be considered as having a unit for separating the sludge layer from the sheet and for transforming it into an agitated suspension and a unit for collecting and flowing out the agitated sludge.

As illustrated, the unit for removing the sludge layer from the tube plate comprises two lances 19 used during a same sequence and constructed for being inserted each through an eye-hole 16 and moved radially between two adjacent sheets or rows of tubes, i.e. in a free space whose width is typically about 10 mm.

Referring to FIGS. 2–5, lance 19 comprises a guiding and feeding part 23 and a head 24 secured to part 23 by suitable connecting means. Such means should be arranged for removing danger of loss of the head within the enclosure. The guiding part is designed for being horizontally flexible. It has two vertically superposed pipes 27 and 28 (FIG. 3) connected by a central core formed with openings and by two lateral metal walls 25, 26. Each lateral wall 25, 26 may be of thin metal sheet in which rectangular apertures are formed by stamping and folding fins 32, 33 inwardly. The core, fins and pipes are embedded in a thermoplastic material 31. The fins are of such length that they retain the central core 34. It is seen that the guiding part 23 has consequently evenly distributed openings which constitute teeth meshing with cooperating teeth of a driving mechanism which will be later described.

Head 24 comprises a metal part defining a water box into which pipes 27 and 28 open. Recesses for receiving fingers 42, 43 fast with the lateral walls 25, 26 are formed in the rear portion of the head. Pins may be provided for securely connecting the fingers to the head.

The water box is provided with two jet nozzles for delivering streams of cleaning water. As shown, the nozzles are formed as oblique ports formed in a section of the head which has an increased thickness. The ports deliver jets which are directed symetrically and with a downward slope. That construction makes it possible to build a lance whose width does not exceed 10 mm, i.e. the width of a tube row lane between two sheets of tubes 7. The height may be about 45 mm, lower than the diameter of a conventional eye-hole.

Due to its construction, the lance has an amount of vertical flexure which remains acceptable when it has a maximum amount of cantilever inside the enclosure. For decreasing the value of the forces exerted onto the head, an upwardly directed port 40 may be formed in the head to deliver a balancing water stream.

The lance may be associated with a driving mechanism of the type shown in FIGS. 4–5. That mechanism bends the portion of the lance immediately outside the enclosure for decreasing the space requirements in the radial direction to a value corresponding to the space available between the enclosure and a surrounding shield. The lance may consequently be one-part and operated without addition or removal of individual length sections. This is of particular importance since the transverse space between adjacent rows of tubes would impose severe limitations on the size of the connecting part and connection would require an operator in an area subjected to a substantial amount of radiation.

Modified embodiments will now be described with reference to FIGS. 2A–2D.

The head illustrated in FIG. 2A differs from that in FIG. 2 in that it comprises more than one set of two nozzles opening one on each side of the head. The upper tube 27 feeds a first set of nozzles 38 whose angular direction is the same as that of the nozzles in FIG. 2. The lower tube 28 delivers water to two sets of nozzles, whose slopes are 40° and 70°, respectively, for striking the plate at shorter horizontal distances from the lance.

The head illustrated in FIG. 2A is particularly suitable for sweeping the sludge after it has been torn out of the plate during a first operation consisting of several successive sequences each with a single set of nozzles.

However, as will be indicated later, a head of the type shown in FIG. 2A may be used for removing and sweeping out the sludge during a single pass of the lance, with a "Pilgrim step" advance mechanism.

The modification illustrated in FIGS. 2B and 2C (where the components corresponding to those illustrated in FIG. 2 are designated by the same reference numerals) differs from that of FIG. 1 in respect of water feed. The head of FIGS. 2B and 2C has three flexible feeding lines which are extended by corresponding tubes opening into a chamber 18 provided with an upwardly directed balancing orifice 40. Partitions 81 terminating close to the end portion of the head separate the flows from the different tubes. The head illustrated in FIG. 2B is for short distance action. It comprises two sets of nozzles 82 having the same angular direction and whose longitudinal spacing corresponds to the distance between two successive heat exchange tubes in a same sheet. Indices 83 may be grooved on the head and the lance for detection purpose. The spacing between two successive indices on the lance corresponds to the distance between heat exchange tubes. As compared to the embodiment of FIG. 2, that modified embodiment may provide an increased water flow.

After the head illustrated in FIG. 2B has been used during a first sequence, other heads which deliver streams at a greater distance may be used, particularly for removing the sludge from the spaces between the heat exchange tubes of the central portion of a heat exchanger. For instance, a head whose nozzles have the angular position illustrated in FIG. 2D may be used during a second sequence. Last, during a third sequence, a head may be used whose nozzles have the angular position indicated in dash-dot lines in FIG. 2.

According to another modification, the central core 34 of FIG. 4 is substituted with a metal strip constituting that lateral surface of the lance which is opposed to that formed with teeth.

Referring to FIGS. 4 and 5, there is shown a mechanism for pushing and pulling lance 19 which is carried by a supporting base plate 60. The plate carries a guiding unit having two parallel curved tracks 61. The guiding part 23 circulates between the tracks 61 and meshes with endless belts 62 having a toothed surface. Rollers 23 guide the belts. The driving unit further comprises two driving assemblies located on each side of the tracks along the path of lance 19. Each assembly has a set of two belts 64 having teeth on both sides. Each belt meshes with the guiding part 23 and with driving pinions 65 connected to a motor 66 by transmission means having a torque limiter 67 and a device 68 for measuring the amount of movement of the lance.

In the modified embodiment of FIGS. 6–7, the lance is of rigid construction. It comprises a plurality of vertically superposed pipes (two pipes in the illustrated embodiment). The pipes are connected by distributed spacers 70. A bending apparatus located out of and close to the enclosure receives the lance as it is moved into or out of the enclosure. As illustrated in FIG. 7, the bending unit comprises a plurality of bending rollers 72 carried by base plate 60. The driving mechanism has a chain 72 connected to the rearmost spacer 70 and driven along an endless path by a toothed wheel 73.

It may be that the measuring device 68 is not accurate anough for avoiding striking the heat exchange tubes with eater streams. Then, optical sensors may be provided, as well. Such sensors may cooperate with reference marks 74 distributed along the lance (FIG. 6). Electrical sensors may also be used, for instance an eddy current sensor 75 located at the rear of the head (FIG. 4) for detecting proximity of a heat exchange tube.

The pipes may be fed with water from a motor pumping unit (not shown) by flexible piping. The pump unit may be quite conventional, except that it is provided with means for currint off water feed in response to a signal indicating that the jet nozzles confront a heat exchange tube. The system for detection may be conventional and include measuring apparatus 68 and/or optical or an electrical or optical sensor.

The pump unit may typically be constructed for delivering either of two pressures at will. The higher pressure (more than 200 bars and typically about 300 bars) will be used for destruction of a coherent sludge layer. The lower pressure will be used for cleaning and for dilution of the sludges.

Referring to FIGS. 1 and 9, there is shown a system for collecting and evacuating the sludge which has two lances spraying feed water into the central portion of the tube bundle, whereby there is a water flow directed radially outwardly. The sludge containing water is taken by four sections of flexible piping 22 formed with suction holes 51 which each covers one fourth of the peripheral portion of the enclosure, in the peripheral lane. All four sections are each connected to an ejector 52, only one of which is illustrated in FIG. 9. The driving fluid of that ejector can be water which is also used for cleaning purpose. Due to the high pressure available, a depression as high as 8 m of water may be obtained and provides a sufficient suction for flowing the suspended sludges.

A stream of low pressure sweeping water may further be introduced into the tube lane by nozzles 53 located in the hand hole 17.

Due to that arrangement, the circulation of water may be fully rationalized and dead zones as well as return of sludge toward already cleaned areas may be avoided.

The apparatus which has been described may be used for carrying out a cleaning process in several successive sequences. An example including four sequences will now be defined and includes the use of four successive sets of lances, each providing streams having a predetermined downward slope, the slopes of the streams provided by different sets of lances being different.

During a first sequence, a set of lances are moved from the center portion of the tube plate toward the peripheral portion of the bundle. The jet nozzles are then so directed that the streams of water clean the areas A and forces the sludge to area B. During the second sequence, lances are used which clean area B and force the sludge toward area C and so on, the lances being designed for the different areas to have a slight overlap. A last sequence is carried out with lances whose jet nozzles deliver streams which sweep the whole of the tube bundle (area D in FIG. 10) and drive out the sludge which possibly has deposited during the first three sequences.

It will be appreciated that the use of four successive sequences using lances having jet nozzles which are maintained in an invariable position makes it possible to progressively force, always in the same direction, the sludge toward the periphery of the steam generator, where the sludge is taken by the sections 22.

Each sequence is carried out in the same way: the lances are first completely inserted. They are fed with water under a pressure which may be varied depending whether it is intended to destroy a solid layer (which requires some times a pressure of about 400 bars) or a cleaning operation. The lances are then moved radially outwardly for bringing the jet nozzles 38 in front of the next tube row lane. During that movement, streams are cut off while the jet nozzles 38 are in front of each exchange tube. The jet nozzles are typically cut off for ten seconds while streams are delivered for a duration of about 30 seconds.

Since the streams are delivered into the tube row lanes only, very high water pressures may be used for destroying hardened sludge deposits without damage to the heat exchange tubes.

Since in addition the lances are moved and the streams are delivered according to a predetermined programmed sequence with automatic remote control, there is no need for an operator in close proximity to the steam generator, except for locating the mechanism and removing it. As a consequence, the dose of radiation received by the operators is substantially decreased.

In the modified embodiment of FIG. 11, there is used an injection and suction system which results in a water flow along a same direction in the whole of the peripheral lane. For that purpose, four piping sections are again used and are connected by pairs. Each pair has a section 75 for injecting water under high or medium pressure and a section 76 connected to a pump or an injector for treating a depression which removes the suspended sludge. The sections are located for creating a peripheral flow having a same direction around the whole of the bundle. The pressures and rates of flow are selected for the stream to have a speed higher than 1.6 m/s. In that way, deposit of the suspended sludge may be avoided. The collecting system further includes headers 21 which deliver low pressure water, as in the system hereinbefore defined.

The above-defined arrangement may be substituted with or completed with a section piping located flat on the tube plate around the tube bundle, having an inner chamber 54 for aspirating the sludge loaded liquid, said chamber being connected to suction means (pump or ejector). Two chambers 55 and 56 are also formed in the piping and open on both sides of an inlet slot for the inner chamber 54 (FIG. 12). Chambers 55 and 56 are connected to a pressurized air delivery feed and communicate with the planar lower surface of the tubing through calibrated ports. The lower planar face of the tubing is formed for being applied onto the tube plate. The pressurized air flowing out of chambers 55 and 56 suspends again the sludge which is flowed away along with the cleaning water into inner chamber 54. The pressurized air streams formed on air cushion which supports the tubing and facilitates removal of the sludge.

It will be appreciated that the last described solution makes it possible to disperse again the sludge which may possibly deposit at the periphery due to a temporary interruption of the cleaning or suction. The action of the current collecting system may consequently be complete.

The above described operating sequence includes several successive operations with lances whose nozzles have a slope which is greater during the first operation. It is also possible to remove sludges in a single sequence, with a lance of the type illustrated in FIG. 2A. For that purpose, the lance is moved after each water delivery according to what is called a "Pilgrin step" movement. Then, each space between two sheets of tubes receives water from the head during four successive water deliveries. In other words, movement of the lance may be represented by the following table, where m designates the serial number of the inter-tube space located closest to the water lane, the columns of the table correspond to the first, second, . . . deliveries of water by the lance and the itemized locations indicate the inter-tube spaces which receive streams.

| | n | n + 1 | n + 2 |
|---|---|---|---|
| m | x | | |
| m-1 | x | x | |
| m-2 | x | x | x |
| m-3 | x | x | x |
| m-4 | | x | x |
| m-5 | | | x |
| m-6 | | | |
| . . . | | | |

Numerous embodiments of the invention other than those specifically disclosed by way of examples are available and will be apparent to those skilled in the art. It should be understood that the scope of the following claims shall extend to any equivalent arrangement.

We claim:

1. A process for removal of the sludge deposits on the tube sheet of a steam generator which comprises, in a vertical cylindrical enclosure closed by said sheet, a bundle of parallel heat exchange tubes sealingly connected to said sheet and distributed to form parallel sheets of tubes, including the steps of:

radially moving at least one lance from the center of the tubular plate between two parallel sheets of tubes, in a direction parallel to the tube sheet and in close proximity to the latter, directing toward the plate two streams of cleaning fluid under a high pressure from the end portion of the lance and in directions which are fixed and symmetrical with respect to the direction of said two sheets of tubes, cutting off the streams as they confront the tubes during radial movement of the lance, and flowing the cleaning fluid out of the enclosure of the steam generator from the periphery of the bundle of tubes.

2. Process according to claim 1, including several sequences of cleaning operations with lances which direct streams of the cleaning fluid striking the tube plate in zones which are more remote from the lance in each successive sequence.

3. Process according to claim 1, for use in steam generators whose tubes are of the U shape, each said tubes having a hot leg and a cold leg separated by a tube lane, wherein said lance is radially moved between adjacent sheets of tubes having a direction perpendicular to said tube lane and close to the tubular plate.

4. Process according to claim 1, 2 or 3, wherein two of said lances are simultaneously and symmetrically moved from a central portion of said steam generator for sweeping the whole of the tubular plate.

5. Process according to the claim 1, wherein the sludge loaded fluid is collected at the periphery of said bundle of tubes and is evacuated toward headers projecting out of said enclosure through holes aligned in a direction perpendicular to a hole through which said lance is inserted.

6. Apparatus for removing the sludge deposits on the tube plate of a steam generator which comprises, in a vertical axis cylindrical enclosure closed by said tubular plate, a bundle of parallel heat exchange tubes connected to said plate, distributed into sheets and flowed by a primary high temperature fluid, comprising:

at least one lance having a transversal size small enough for said lance to be insertable between two adjacent sheets of tubes, having an end portion provided with nozzle jets angularly located for directing angularly tilted streams in substantially symmetrical directions with respect to the sheets of tubes toward the tubular plate, means for feeding high pressure fluid to the lance and for cutting off fluid feed when the nozzle jets are confronting individual ones of said tubes, means for radially moving said lance from a center portion of the enclosure toward an outer portion thereof while retaining it in fixed angular position about its direction of movement, and means at the periphery of the bundle of tubes for collecting and evacuating sludge loaded fluid.

7. Apparatus according to claim 6, wherein the end portion of said lance comprises a portion having a flat cross-section with at least two lateral nozzle jets, the thickness of said head portion being lower than the spacing between two adjacent sheets of said tubes and a height higher than said spacing whereby said lance is prevented from rotating and the lance has a rigidity in the vertical direction preventing substantial flexure in the vertical direction.

8. Apparatus according to claim 7, wherein the end portion of said lance is provided with a port directed upwardly for delivering a stream resulting in a force which balances the vertical forces due to the streams delivered by the jet nozzles toward the tubular plate.

9. Apparatus according to claim 6 for use in a steam generator wherein the space available outside of the enclosure in front of holes through which said lance is inserted into the enclosure is lower than the length on which said lance should project into said enclosure, wherein said lance is constructed and arranged for being deformable in an horizontal direction while it is rigid in the vertical direction and wherein the drive means for said lance is arranged for curving the lance horizontally at the outside of said enclosure.

10. Apparatus according to claim 6, wherein said lance carries a proximity sensor for indicating coincidence between said jet nozzles and any one of said tubes.

* * * * *

UNITED STATES PATENT AND TRADEMARK OFFICE

CERTIFICATE OF CORRECTION

PATENT NO. : 4,424,769

DATED : January 10, 1984

INVENTOR(S) : André G. Charamathieu et al.

It is certified that error appears in the above-identified patent and that said Letters Patent is hereby corrected as shown below:

Figures 11 and 12 should appear as shown on the attached sheet.

Signed and Sealed this

*Ninth* Day of *October 1984*

[SEAL]

*Attest:*

*Attesting Officer*

GERALD J. MOSSINGHOFF

*Commissioner of Patents and Trademarks*

Patent No. 4,424,769 January 10, 1984

André G. Charamathieu et al.